US006354063B1

(12) United States Patent
Golownia

(10) Patent No.: US 6,354,063 B1
(45) Date of Patent: Mar. 12, 2002

(54) METHOD OF INHIBITING NON-DISPERSIBLE PAINT SKIN FORMATION INSIDE PAINT CANS OF LATEX PAINTS

(75) Inventor: Robert F. Golownia, Hudson, OH (US)

(73) Assignee: The Glidden Company, Cleveland, OH (US)

( * ) Notice: Subject to any disclaimer, the term of this patent is extended or adjusted under 35 U.S.C. 154(b) by 0 days.

(21) Appl. No.: 09/528,896

(22) Filed: Mar. 20, 2000

(51) Int. Cl.[7] ..... B65B 55/22; B65B 3/04

(52) U.S. Cl. ..... 53/431; 53/467; 53/474; 53/111 R

(58) Field of Search ..... 53/401, 402, 431, 53/467, 474, 111 R, 111 RC, 237, 284.5

(56) References Cited

U.S. PATENT DOCUMENTS 4,228,893 A * 10/1980 Franklin et al.
5,323,588 A * 6/1994 Zak et al. ..... 53/401 X
5,911,251 A * 6/1999 Muscara et al. ..... 53/402

* cited by examiner

*Primary Examiner*—Stephen F. Gerrity
(74) *Attorney, Agent, or Firm*—Thomas M. Schmitz

(57) ABSTRACT

Latex paint in a container is inhibited against skinning by providing a thin layer of an aqueous mixture of diethylene glycol on the exposed surface of the latex paint after the container is filled with the paint.

7 Claims, No Drawings

METHOD OF INHIBITING NON-DISPERSIBLE PAINT SKIN FORMATION INSIDE PAINT CANS OF LATEX PAINTS

This invention pertains to latex air dry paints and more specifically to a method of inhibiting non-water-dispersible paint skin formation on the interior lids of containers for latex paints.

BACKGROUND OF THE INVENTION

Paint coatings are surface coatings applied to substrates and dried to form continuous films for decorative purposes as well as to protect the substrate. Most consumer paint coatings are air-drying aqueous coatings applied primarily to architectural interior or exterior surfaces, where the coatings are sufficiently fluid to flow out, form a continuous paint film, and dry at ambient temperatures to protect the substrate surface. A paint coating ordinarily comprises an organic polymeric binder, pigments, and various paint additives. In dried paint films, the polymeric binder functions as a binder for the pigments and provides adhesion of the dried paint film to the substrate. The pigments may be organic or inorganic and functionally contribute to opacity and color in addition to durability and hardness. Some paint coatings contain little or no opacifying pigments and are described as clear coatings. The manufacture of paint coatings involves the preparation of a polymeric binder, mixing of component materials, grinding of pigments in a dispersant medium, and thinning to commercial standards.

Latex paints for the consumer market ordinarily are based on polymeric binders prepared by emulsion polymerization of ethylenic monomers. A typical consumer latex paint binder may contain a vinyl acetate copolymer consisting of polymerized vinyl acetate (80%) and butyl acrylate (20%). The hardness of the latex polymer must be balanced to permit air drying and film formation at ambient temperatures, which requires soft polymer units. At the same time the polymer must be hard enough in the final dry film to provide resistance properties, which requires hard polymer units. Coalescing solvents function to externally and temporarily plasticize the latex polymer for time sufficient to develop film formation, but then diffuse out of the coalesced film after film after film formation, which permits film formation and subsequent development of the desired film hardness by the volatilization of the coalescent. Such latex paints are prone to develop water insoluble films, commonly known as "skins", on the non-submerged interior surfaces of plastic or metal containers used for shipping paint products. Skinning on container lids is a particularly troublesome problem. A paint skin formed in the absence of an inhibitor will not uniformly re-disperse into the bulk paint during shaker mixing that is normally carried out prior to application of the paint product. Unattractive defects in the dried paint film will result from including pieces of the skin due to their irregular shape and size. Paint skin fragments also can lead to troublesome clogging of spray guns that are often used for application of the paints.

Skinning of latex-based paint products in closed containers has been a puzzling phenomenon known in the paint industry for many years. Prevalent thinking suggests that latex paint skinning is a drying process that requires moisture to escape from the closed container by permeating through the container walls and/or by escaping from leaks caused by insufficient sealing of the lid to the container body. The use of inhibiting mixtures of water and relatively volatile glycols, particularly ethylene glycol, to inhibit skinning in latex paint cans is disclosed in U.S. Pat. No. 4,228,893, which teaches that inhibiting aqueous glycol mixtures having a volatility greater than the volatile portion of the paint composition can be placed on the surface of the liquid paint, ordinarily one to three inches thick layer, and should be more viscous than the paint composition in the can. In practice however, it was found that such relatively high viscosity skin inhibiting mixtures mixed extensively into the bulk of the paint during handling and shipping, and, consequently became sufficiently diluted and ineffective skin inhibitors.

A method and composition now have been found to inhibit waterborne paint products from developing water insoluble films, commonly known as skins, on the non-submerged interior surfaces of the plastic or metal containers. The inhibiting composition relies on the use of a relatively small amount of a mixture consisting primarily of low volatility diethylene glycol added to the container after the paint product itself has been added. The low volatility glycol and water mixtures of the present invention resist evaporation to the point where even though most or all of the water has evaporated from the paint/inhibitor mixture, sufficient low volatility glycol remains to enable the resultant pasty mixture to be re-dispersed into the bulk paint during normal pre-use mixing with a paint shaker. The low volatility diethylene glycol mixture is purposefully not mixed into the paint but rather is allowed to float on the surface of the previously added latex paint. In accordance with this invention, diethylene glycol having relatively low volatility is used as the major or only component of the skin inhibiting mixture formulated to have relatively low viscosity and used in relatively small amounts. It has been found that useful skin inhibiting aqueous glycol mixtures containing diethylene glycol which is less volatile than the major volatile portion of the latex paint and provides excellent skin inhibiting properties to the latex paint in a container. It has been found that aqueous glycol mixtures which are less viscous than the bulk paint remain on the top of the paint bulk surface during handling and shipping of the filled containers. The layer of inhibiting aqueous glycol can be well below one inch and as low as 1/16 of an inch thickness. These and other advantages of this invention will become more apparent by referring to the detailed description and illustrative examples.

SUMMARY OF THE INVENTION

Briefly, the invention pertains to a composition and method of inhibiting a waterborne latex paint from forming insoluble films, commonly known as skinning, on the interior surfaces of the lid and exposed wall surfaces of containers filled with latex paint. The inhibiting composition consists of non-viscous, low volatility diethylene glycol having a volatility considerably less than the volatility of the volatile portion (water+organic solvent) of the paint. The diethylene glycol preferably is dispersed in water. The inhibiting diethylene glycol is inserted into the paint container and onto the paint surface after the container is filled with paint prior to shipping. The inhibiting diethylene glycol is maintained as a distinct layer on top of the paint and intentionally is not mixed with the paint.

DETAILED DESCRIPTION OF THE INVENTION

The invention is based on low volatility, non-viscous, inhibiting diethylene glycol or diethylene glycol mixtures containing small amounts of water mixed with diethylene glycol. The inhibiting diethylene glycol exhibits low volatility and low viscosity to provide a small but distinct barrier layer of inhibiting composition on the latex paint surface in a container. These useful inhibiting glycol mixtures are substantially less volatile than the volatile portion (water+organic solvent) of the latex paint being protected. Mixtures useful for inhibiting skin formation comprise diethylene glycol alone or a mixture of glycols containing by weight between about 95% and 100% diethylene glycol. The inhibiting glycol mixtures can contain between 5% and 80% water based on the total weight of glycol and water mixture.

Low viscous diethylene glycol+water mixtures being less viscous than the paint in accordance with this invention effectively inhibits the latex paint from skinning in the container since the low viscous glycol+water mixture remains on top of the paint surfaces during handling and shipping of the paint filled containers. In contrast, high viscosity glycol+water mixtures undesirably become diluted within the paint during transit and handling thereby minimizing or eliminating skin inhibiting properties. Inhibiting diethylene glycol mixtures of this invention can be used as thin film barriers as little as 1/16 inch thickness, and preferably between about 1/16 and 1/4 inch thick barrier film, to adequately provide continuous surface coverage of the paint in the container. The low volatility and low viscosity diethylene glycol and water mixtures of this invention resist paint evaporation to the point where, even though the water from the inhibiting composition may evaporate, sufficient low volatility glycol remains to form a pasty mixture which can be readily redispersed into the paint bulk during normal paint mixing in the can before use. In contrast, a paint skin formed in the absence of the inhibiting composition of this invention will not redisperse into the paint due to irreversible drying and coalescence of the latex paint film on the exposed areas of the container. Temperature differences between the container lid and non-submerged interior walls of the container relative to the bulk paint, which is the result of normal fluctuations in ambient temperature normally encountered in storage and shipping causes paint skinning inside paint containers. For example, a five gallon container of paint was found to cool to about 60° F. while stored overnight in an exterior environment followed by ambient temperatures increasing considerably during the daytime, thereby causing dried paint formation on the lid and non-submerged interior wall surface. Temperature differentials measured by thermocouples showed that during daytime hours the paint adhering to the underside of the lid reached and remained 15 to 20° F. warmer than the paint bulk temperature reached from storing at lower temperature the previous night. It has been found that latex paint skinning is indeed likely to be drying process but that it is caused by the transfer of moisture from liquid paint adhering to the lid and/or non-submerged walls of the container to the bulk paint by differences in the temperature between paint on the lid and container walls and paint in the bulk. Such temperature differences are the result of normal fluctuations in the ambient temperature at which the paint is stored. Because the thermal heat capacity of the paint/lid combination is less than the heat capacity of the bulk paint/container combination, temperature differences will occur as the ambient temperature changes.

Latex paints are based on conventional aqueous emulsion copolymerized ethylenically unsaturated monomers to form the film forming binder. The film forming binders for latex paints typically are vinyl or acrylic copolymer binders. The film-forming binders can be vinyl copolymer binders containing at least 40% and preferably between about 80% to 100% of copolymerized vinyl unsaturated monomers containing vinyl double bond unsaturation including, for example, vinyl esters such as vinyl acetate, vinyl propionate, vinyl butyrates, vinyl benzoate, isopropenyl acetate and like vinyl esters; vinyl amides, such as acrylamide and methacrylamide; and vinyl halides such as vinyl chloride. Ethylenically unsaturated monomers other than said vinyl unsaturated monomers can include, for example, those monomeric materials exhibiting ethylenic double bond unsaturation such as polymerizable allylic, acrylic, fumaric, maleic, or like ethylenically unsaturated double bond functionality (carbon-to-carbon unsaturation) which can be copolymerized with the vinyl double bond in said vinyl unsaturated monomers. Ethylenically unsaturated monomers other than vinyl unsaturated monomers can include, for example, styrene, methyl styrenes, and similar alkyl styrenes, chlorostyrene, vinyl toluene, vinyl naphthalene, divinyl benzene, diallyl phthalate and similar diallyl derivatives, butadiene, alkyl esters of acrylic and methacrylic acid and similar ethylenically unsaturated monomers.

Other suitable binders based on acrylic copolymers including copolymerized low alkyl esters of acrylic or methacrylic acid having an alkyl ester portion containing between 1 to 12 carbon atoms as well as aromatic derivatives of acrylic and methacrylic acid. Useful acrylic monomers include, for example, acrylic and methacrylic acid, methyl acrylate and methacrylate, ethyl acrylate and methacrylate butyl acrylate and methacrylate, propyl acrylate and methacrylate, 2-ethyl hexyl acrylate and methacrylate, cyclohexyl acrylate and methacrylate, decyl acrylate and methacrylate, isodecylacrylate and methacrylate, benzyl acrylate and methacrylate, and various reaction products such as butyl, phenyl, and cresyl glycidyl ethers reacted with acrylic and methacrylic acids, hydroxyl alkyl acrylates and methacrylates such as hydroxyethyl and hydroxypropyl acrylates and methacrylates, as well as amine acrylates and methacrylates.

The ethylenically unsaturated monomers can be copolymerized by free radical induced addition polymerization using peroxy or azo catalysts, common redox catalysts, ultraviolet radiation, or the like. Latex paints ordinarily contain opacifying pigments, tinctorial pigments for imparting color, and non-opacifying filler or extender pigments. Latex points film are formed by coalescence of the film forming binder polymer particles at ambient temperatures to form a binding matrix and a hard tack-free paint film. Particularly desirable coalescing solvents are phenyl ether of diethylene glycol, diethylene glycol butyl ether, and dibutyl phthalate, diethylene glycol monobutyl ether acetate or monoethyl ether acetate, and 2,2,4-trimethyl-1,1,3, pentanediol monoisobutyrate.

Latex paints are inhibited from forming skins in containers by placing small amounts of an inhibiting diethylene glycol mixture on the top surface of paint previously filled into containers. Useful levels are between 1/16 inch and 1 inch layer to cover the paint surface. For one gallon cans, between one and two ounces of inhibiting glycol mixture should be used, while between four and eight ounces should be used for five gallon containers, to provide a preferred inhibiting layer of about 1/8 inch thickness.

The merits of this invention are further illustrated by the following examples.

Skinning Tests

Laboratory tests have shown that temperature differences between paint adhering to the lid and paint located in the bulk caused skinning to occur in relatively short periods of time. Using thermostatted water baths to maintain temperature differences, skinning of a commercial latex wall paint occurred at various times depending on the magnitude of the temperature difference. The onset of skinning was determined by measuring the direct current electrical resistance of the wet paint film adhering to the container lid. Electrical contact was made through two ¼ inch strips of aluminum foil glued to the interior surface of the plastic lid while electrical resistance was monitored with a Radio Shack model #22-168A multimeter interfaced with a Compaq Prolinea 466 computer. Skinning time was noted as the time required for the electrical resistance to begin a sudden increase due to the elimination of water in the paint film. In this example, paint on the lid was maintained at 120° F. while paint in the bulk of the container was maintained at 60° F. Electrical resistance began a sudden increase at about 2.8 hours after beginning the test. This time was determined to be the time required for a paint skin to form on the lid surface.

TABLE 1.

Skinning time for a latex paint at different lid and bulk paint temperatures.

| Bulk Paint Temperature | Lid Temperature | Time to Skin |
|---|---|---|
| 60 F. | 80 F. | 4.1 hours |
| 60 F. | 100 F. | 1.8 hours |
| 60 F. | 20 F. | 0.8 hours |

Using the same test, a wide variety of other commercially available latex paints produced similar results.

EXAMPLE 1

A similar test was carried out using the same latex wall paint as in the table above but containing sufficient diethylene glycol skin inhibiting mixture added to be equivalent to six ounces of skin inhibitor mixed with the topmost 0.25 inches of paint contained in an ordinary commercial five gallon paint pail. As described below, it was found in practice that low viscosity skin inhibiting mixtures which have been floated on the liquid paint surface are mixed to a depth of about 0.25 inches into the bulk paint contained in a five gallon pail during the course of typical handling and shipping activities. Results of such testing using ethylene glycol compared to a significantly lower volatility glycol, diethylene glycol, of this invention are shown below. The lid temperature=120 F., while the bulk paint temperature=60 F. In this particular test series, time to skin was determined by visual inspection of the lids after the time intervals noted in the table.

TABLE 2

| Time of Observation (hours) | Mixture #1 100% Water | Mixture #2 85% Ethylene glycol 15% Water | Mixture #3 85% Diethylene glycol 15% Water |
|---|---|---|---|
| 0.5 | Edges dry, center wet | Wet | Wet |
| 1.0 | Completely dry | Pasty, but not dry | Pasty, but not dry |
| 1.5 | Completely dry | Pasty, but not dry | Pasty, but not dry |
| 2.0 | Completely dry | Pasty, but not dry | Pasty, but not dry |
| 3.0 | Completely dry | Pasty, but not dry | Pasty, but not dry |
| 4.0 | Completely dry | Pasty, but not dry | Pasty, but not dry |
| 5.0 | Completely dry | Pasty, but not dry | Pasty, but not dry |
| 6.0 | Completely dry | Edges dry, center wet | Pasty, but not dry |

TABLE 2-continued

| Time of Observation (hours) | Mixture #1 100% Water | Mixture #2 85% Ethylene glycol 15% Water | Mixture #3 85% Diethylene glycol 15% Water |
|---|---|---|---|
| 7.0 | Completely dry | Nearly dry throughout | Pasty, but not dry |
| 16 (overnight) | Completely dry | Completely dry | Pasty, but not dry |

Even after five days, the diethylene glycol containing paint had not skinned but rather formed a paste-like mixture which easily re-dispersed into the bulk paint with normal mixing on commercial paint shaker.

Using the same procedure as used in Table 2, propylene oxide-derived glycols were found to be less effective as skin inhibitors:

| Skin Inhibitor | Time to Skin |
|---|---|
| Propylene glycol | 8 hrs. |
| Dipropylene glycol | 3 days |
| Tripropylene glycol | 3 days |

Mixing Tests

Several potential skin inhibiting mixtures were colored with a water soluble blue dye and then six liquid ounces of each mixture were poured onto the surface of a white commercial latex paint previously filled into five gallon pails. The pails were subsequently sealed with matching lids, palletized and surface shipped to a distant location. After shipping was completed, the pails were opened and the contents were assessed for the extent of mixing between the skin inhibiting mixture and the bulk paint by noting the presence of blue color in the paint at various depths below the surface. Color at various depths was determined by withdrawing several milliliters of paint with a plastic pipette inserted to each depth and by spreading the paint sample onto a white test chart and allowing it to dry before noting color differences. If a blue color was noted, it was concluded that the trial mixture had mixed to the depth at which the sample was withdrawn.

| Mixture # | Mixture Composition | Brookfield Viscosity | Maximum Mixing Depth |
|---|---|---|---|
| Model RV | | | |
| 1. | Water: 1000 parts<br>Blue dye*: 30 parts | 9.5 mPa · s<br>100 RPM | 1 inch |
| Spindle | | | |
| 2. | Water: 990 parts<br>Cellulosic thickener**: 10 parts<br>Blue dye: 30 parts | 800 mPa · s<br>20 RPM<br>Spindle #2 | >2 inches |
| 3. | Water: 150 parts<br>diethylene glycol 850 parts<br>Blue dye 30 parts | 35 mPa · s<br>100 RPM<br>Spindle #1 | 1/8 inch |
| 4. | Water: 136 parts<br>Ethylene glycol: 850<br>Cellulosic Thickener: 14 parts<br>Blue dye: 30 parts | 166 mPa · s<br>100 RPM<br>Spindle #2 | 1 inch |
| 5. | Water: 128 parts<br>Ethylene glycol: 850 parts<br>Cellulosic thickener: 22 parts | 448 mPa · s<br>50 RPM<br>Spindle #2 | >4 inches |

-continued

| Mixture # | Mixture Composition | Brookfield Viscosity | Maximum Mixing Depth |
|---|---|---|---|
| | Blue dye: 30 parts | | |

*Blue dye: FD&C Blue #2 Food color
**Cellulosic thickener: Natrosol Plus 330

Those mixtures which had the highest viscosity (Mixtures #2, 4 and 5), showed the greatest degree of mixing with the bulk paint during typical handling and surface transportation. Those mixtures which contained no cellulosic thickener (#1 and #3) and consequently had lower viscosities, were more resistant to mixing during handling and transportation.

EXAMPLE 2

Effective embodiments of the present invention include a skin inhibiting mixture of diethylene glycol and water as described as Mixture #3 above and a mixture similar to Mixture #3 above which also includes a small amount of added surfactant.

To assess the effectiveness of three different skins inhibiting materials, tests were carried out by pouring six liquid ounces of each material onto the surface of a typical latex paint that had been filled into ordinary 5 gallon plastic pails. Twenty-four pails were treated with each mixture before being sealed with matching lids, palletized and surface shipped to a distant location. After shipping was completed, the pails were opened and assessed for the extent of skinning by gently scrubbing the lid with a soft brush and rinsing with water to dislodge any skins which may have formed on the lid's inside surface. The rinsings were then filtered after which the filter residues (paint skins) were allowed to dry at room temperature before weighing. Results in the table below show the effectiveness of mixtures containing diethylene glycol in accordance with this invention. Also shown is the effect of pail position on the extent of skinning. Pails in the top layer on a pallet showed more skinning, presumably because the lids of those pails reach the highest temperature during storage and transportation. Pails in the middle and bottom layers of the typical pallet (which is stacked with three layers of pails) were somewhat insulated from changes in the ambient temperature by the top layer of pails.

TABLE 2

| Mixture # | Mixture Composition | Pail Position in Pallet | Average Weight of Skins in Each layer of Six Pails (grams) |
|---|---|---|---|
| 1. | Water: 1000 parts<br>Blue dye*: 30 parts | Top layer | 20.40 |
| 1. | Same | Middle layer | 6.56 |
| 1. | Same | Bottom layer | 7.89 |
| 2. | Water: 150 parts<br>Diethylene glycol: 850 parts<br>Blue dye: 30 parts | Top layer | 5.47 |
| 2. | Same | Middle layer | 4.09 |
| 2. | Same | Bottom layer | 5.18 |
| 3. | Water: 140 parts<br>Diethylene glycol: 850 parts<br>Nonionic surfactant: 10 parts | Top layer | 6.64 |

TABLE 2-continued

| Mixture # | Mixture Composition | Pail Position in Pallet | Average Weight of Skins in Each layer of Six Pails (grams) |
|---|---|---|---|
| | Blue dye: 30 parts | | |
| 3. | Same | Middle layer | 4.37 |
| 3. | Same | Bottom layer | 1.80 |

The table also shows that other materials, for example, surfactants may be added to the diethylene glycol/water mixture.

EXAMPLE 3

In another example of the invention, 5 gallon pails of latex paint were treated with six ounces of either pure water or with six ounces of a mixture of 85 parts of diethylene glycol and 15 parts of water. Several pallets of 24 pails each were then shipped to a retail paint store and allowed to remain in storage for ten weeks. At the end of this period, the amount of skin formation was assessed using the same procedure as for Table 2 above.

TABLE 3.

Skin formation in pails of latex paint with and without skin inhibitor.

| | Pail Position in Pallet | No Inhibitor skin wt. (grams) | Pure Water Inhibitor skin wt. (grams) | Diethylene glycol-Water (85–15 w/w) Inhibitor skin wt. (grams) |
|---|---|---|---|---|
| | Top | 4.13 | 4.62 | 0.91 |
| | Top | 2.85 | 7.24 | 0.77 |
| | Top | 5.00 | 5.65 | 0.90 |
| | Top | 1.34 | 5.68 | 1.59 |
| | Top | 2.30 | 3.96 | 1.75 |
| | Top | 2.11 | 6.41 | 1.62 |
| | Top | 3.83 | 6.36 | 0.84 |
| | Top | 2.72 | 4.93 | 2.72 |
| Average | | 3.04 | 5.61 | 1.39 |
| | Middle | 7.48 | 2.25 | 0.04 |
| | Middle | 20.35 | 4.02 | 0 |
| | Middle | 6.25 | 2.18 | 0 |
| | Middle | 19.01 | 2.83 | 0 |
| | Middle | 16.66 | 2.84 | 0 |
| | Middle | 6.59 | 2.44 | 0 |
| | Middle | 7.42 | 2.47 | 0 |
| | Middle | 8.18 | 2.64 | 0 |
| Average | | 11.49 | 2.71 | 0.005 |
| | Bottom | 14.39 | 2.04 | 0 |
| | Bottom | 14.25 | 2.01 | 0 |
| | Bottom | 10.88 | 1.75 | 0 |
| | Bottom | 16.94 | 1.96 | 0 |
| | Bottom | 17.06 | 1.55 | 0 |
| | Bottom | 8.10 | 1.60 | 0 |
| | Bottom | 12.71 | 1.35 | 0 |
| | Bottom | 5.96 | 1.76 | 0 |
| Average | | 12.54 | 1.75 | 0.00 |
| Grand Average | | 9.02 | 3.36 | 0.46 |

The data clearly shows the superior efficacy of the skin inhibiting mixture which contains diethylene glycol. Pails with no inhibitor formed over 9 grams of skin on the average. Pails with pure water as the inhibitor formed over 3 grams of skins, while pails containing the diethylene glycol-water inhibitor formed less than 0.5 grams of skin. Most pails using the diethylene glycol-water inhibitor mixture formed no skin at all.

The foregoing illustrative examples are not intended to be limiting of the invention except by the following claims.

What is claimed is:

1. A method of inhibiting non-dispersible, water insoluble, paint skin formation on non-submerged surfaces of a container containing latex paint filled into the container, where the filled latex paint has an upper surface exposed to air within the container, comprising:

providing an inhibiting aqueous mixture comprising diethylene glycol, the aqueous mixture having between 5% and 80% by weight water;

disposing a thin layer of the aqueous diethylene glycol mixture over the upper exposed surface of latex paint in the container after the latex paint has been filled into the container to provide a continuous thin layer of aqueous diethylene glycol mixture on the upper surface of the paint; and closing the container while maintaining the thin layer of aqueous diethylene glycol mixture on the upper surface of the latex paint.

2. The method in claim 1 wherein the diethylene glycol in the aqueous mixture comprises by weight between 95% and 100% diethylene glycol.

3. The method of claim 2 wherein the diethylene glycol consist substantially of 100% diethylene glycol.

4. The method of claim 1 where the thin layer of aqueous diethylene glycol mixture is between about 1/16 inch and 1 inch thick.

5. The method of claim 4 where the thin layer thickness is between 1/16 and 1/4 inch thickness.

6. The method of claim 1 wherein between 1 and 2 ounces of the aqueous diethylene glycol mixture is added to a one gallon container.

7. The method of claim 1 wherein between 4 and 8 ounces of the aqueous diethylene glycol mixture is added to a five gallon container.

* * * * *